US005110054A

United States Patent [19]

Stevens

[11] Patent Number: 5,110,054

[45] Date of Patent: May 5, 1992

[54] FUEL INJECTOR

[75] Inventor: John W. Stevens, Kent, England

[73] Assignee: Lucas Industries, Solihull, England

[21] Appl. No.: 610,839

[22] Filed: Nov. 5, 1990

[30] Foreign Application Priority Data

Nov. 23, 1989 [GB] United Kingdom ..... 8926478

[51] Int. Cl.[5] ..... F02M 61/12

[52] U.S. Cl. ..... 239/533.11; 239/553.3; 239/533.12

[58] Field of Search ..... 239/533.2–533.12, 239/88, 91, 96

[56] References Cited

U.S. PATENT DOCUMENTS 4,071,197 1/1978 Bailey et al. ..... 239/533.11
4,941,613 7/1990 Hardy et al. ..... 239/533.2

FOREIGN PATENT DOCUMENTS 129165 7/1932 Austria ..... 239/533.3
705129 3/1954 United Kingdom ..... 239/533.11
1238466 7/1971 United Kingdom ..... 239/533.11
2113760 8/1983 United Kingdom ..... 239/533.7
2215397 9/1989 United Kingdom ..... 239/533.12

*Primary Examiner*—Andres Kashnikow
*Assistant Examiner*—Karen B. Merritt
*Attorney, Agent, or Firm*—Abelman Frayne & Schwab

[57] ABSTRACT

A fuel injector for supplying fuel to an engine has an elongated body in which is defined a bore at one end of which is formed a seating. Located with clearance within the bore is a fuel pressure actuated elongated valve member which at one end is shaped for co-operation with the seating. At its other end the valve member is guided for movement by a guide bush which is able to move radially to a limited extent in the body. Between the guide bush and the seating the valve member has an enlargement which co-operates with the wall of the bore to ensure that the valve member remains concentric with the seating as it moves away from the seating. The guide bush is conveniently formed by an outer bush and an inner bush with the inner bush able to move axially relative to the outer bush. The fuel pressure at the inlet of the injector acts on the inner bush to assist the initial movement of the valve member away from the seating.

19 Claims, 1 Drawing Sheet

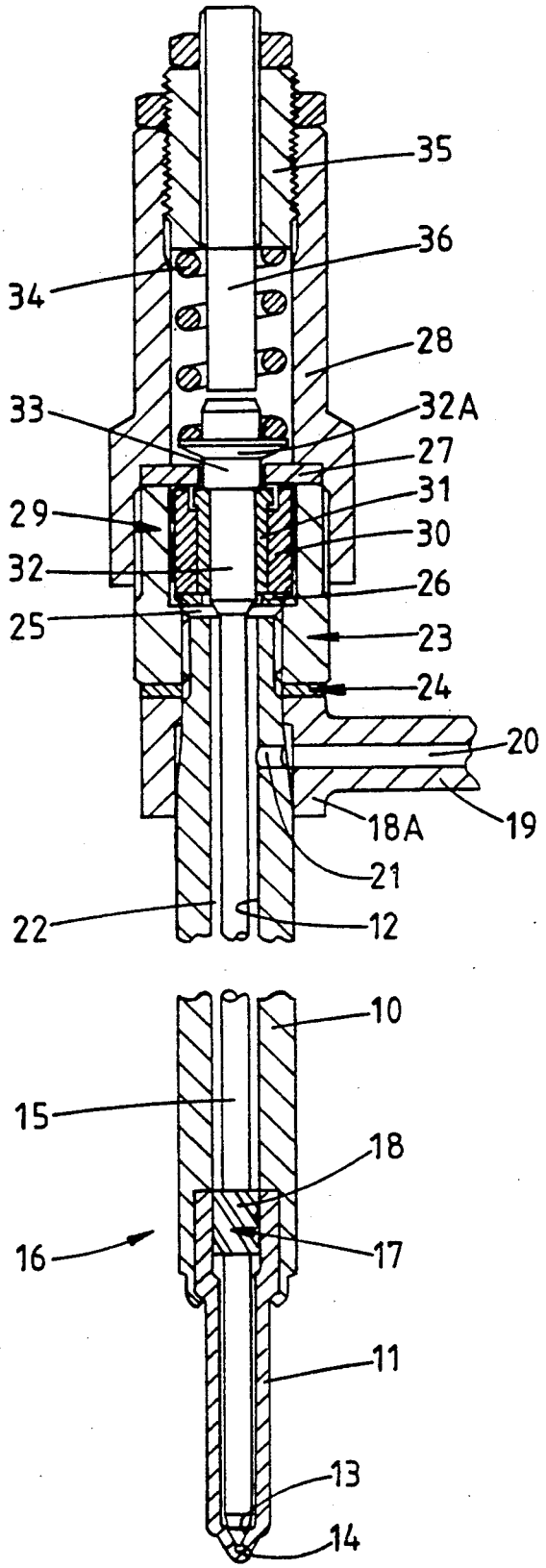
35
36
34
28
33
32A
27
31
29
30
32
26
25
23
24
20
18A
19
21
22
12
10
15
18
16
17
11
13
14

FUEL INJECTOR

FIELD OF THE INVENTION

This invention relates to a fuel injector for supplying fuel to an internal combustion engine, the injector being of the kind comprising an elongated body in which is defined a bore, a seating formed at one end of the bore, an elongated valve member extending with clearance within the bore and shaped at one end for cooperation with said seating to control flow of fuel through an outlet from a fuel inlet which communicates with said clearance, a guide bush carried by the body and located adjacent the other end of the valve member, the valve member being guided for axial movement by the guide bush and resilient means acting on the valve member to urge the valve member into contact with the seating, the valve member defining a surface against which fuel under pressure can act to lift the valve member from the seating.

Such an injector is known in the art as a slim injector. The valve member is substantially longer than in the more conventional injector and one problem has always been the correct alignment of the guide bush to ensure that the valve member co-operates with the seating. In the usual form of injector the outlet is in the form of an orifice which extends from a so-called "sac" which is located downstream of the seating and providing the valve member correctly engages with the seating the concentricity of the valve member and the seating as the valve member moves away from the seating has little effect on the performance of the injector.

BACKGROUND OF THE INVENTION

With modern engines there is an increasing demand that the initial flow of fuel to the engine should be at a controlled rate and in order to achieve this the initial movement of the valve member away from the seating is carefully controlled. In one arrangement the clearance between the valve member and the seating forms a restrictor which restricts the flow of fuel through the outlet orifice. In another arrangement the orifice can extend from immediately downstream of the seating so that the tip of the valve member provides controlled obturation of the inner end of the orifice. With injectors of the types described above it is important to ensure that the valve member remains concentric with the seating as it moves away from the seating.

SUMMARY OF THE INVENTION

The object of the present invention is to provide an injector of the kind specified in a simple and convenient form.

According to the invention in a fuel injector of the kind specified the valve member and the wall of the bore are constructed to form a guide means for the valve member, the guide means being located intermediate the guide bush and the seating, passage means being provided to allow flow of fuel past the guide means, and the guide bush is allowed limited radial movement within the body.

DESCRIPTION OF THE SINGLE DRAWING

An example of a fuel injector in accordance with the invention will now be described with reference to the accompanying drawing which shows the injector in sectional side elevation.

DESCRIPTION OF THE PREFERRED EMBODIMENT

Referring to the drawing the injector comprises a tubular body 10 within one end of which is located a insert 11 which is formed from harder material than the remaining portion of the body. The insert is located within a recess formed in the body with the end portion of the body rolled around a shoulder defined on the insert. Formed in the body is a bore 12 which extends into the insert and at the end of the bore which lies within the insert there is defined a seating 13 which leads into a "sac" volume from which extends an outlet orifice 14. It will be understand that the orifice can extend from immediately downstream of the seating as explained above.

Extending axially within the bore 12 is an elongated valve member 15 which is shaped at its end to co-operate with the seating and intermediate its ends the valve member and bore are shaped to define guide means generally indicated at 16 which guides the movement of the valve member. In the example the valve member is provided with an enlargement 17 which is provided with helical flutes 18 and the enlargement is located in the portion of the bore 12 which lies within the insert.

The end of the body remote from the insert 11 is provided with a screw thread and intermediate the threaded portion of the body and the main portion thereof, the exterior surface of the body is tapered. Located about the tapered portion of the body is a collar 18A which has a bore which is tapered in a complementary manner to the body and the collar also carries a lateral extension 19. Formed in the extension is a passage 20 which communicates with a recess formed in the internal peripheral surface of the collar and which by way of a drilling 21 formed in the wall of the body, communicates with a clearance 22 which is defined between the wall of the bore 12 and the valve member 15. The passage 20 constitutes the fuel inlet of the injector and in use, will be connected to the outlet of a high pressure fuel supply pump.

Engaged with the threaded portion of the body is a tubular body member 23 and interposed between the body member and the collar is a copper or like soft washer 24.

The internal peripheral surface of the tubular body member 23 defines a step against which is located an annular washer 26. A further annular washer 27 is located against the end of the tubular body member remote from the body 10, this being retained in position by means of a cap 28 which is secured about the body member 23. Intermediate the washers is a two-part guide bush generally indicated at 29 and comprising an outer bush 30 and an inner bush 31. The outer bush 30 is slightly smaller in overall diameter than the bore in the tubular body member 23 and furthermore has a small axial clearance with the washers 26 and 27. The bush can therefore move radially and also axially into sealing engagement with the washer 27. The inner bush 31 is a sliding fit within the outer bush 30 and has a slightly smaller axial length so that it can move axially relative to the outer bush 30. The inner bush provides a bearing surface for an enlarged portion 32 of the valve member and in addition the inner bush is provided with a small peripheral flange whereby it can engage with the washer 27. The washer 26 has an internal diameter such that it can be engaged by both the inner and outer bushes. The enlarged portion 32 of the valve member defines with the remaining portion of the valve member a surface against which fuel under pressure on the clearance can act.

Also provided is spring abutment 32A which includes a projection 33 extending with clearance through the washer 27 into engagement with the valve member. The diameter of the projection 33 is slightly larger than that of the valve member so that it can be engaged by the flanged end of the inner bush 31. The spring abutment locates one end of a coiled compression spring 34 the other end of which engages an adjustable abutment 35 which is mounted in the cap 28. The abutment 35 also carries an adjustable stop 36 for engagement by the abutment 32A.

In use and in the absence of fuel under pressure at the inlet, the valve member is urged to the closed position by the spring 34 and if there is any misalignment of the valve member, the guide bush 29 moves in a radial direction to accommodate the misalignment. When fuel under pressure is supplied to the inlet 20 the fuel pressure acts upon the valve member 15 and also upon the inner and outer bushes 31, 30. As a result of the pressure both bushes move axially the inner bush 31 into engagement with the projection 33 on the spring abutment and the outer bush 30 into engagement with the plate 27 with which it forms a fueltight seal to prevent escape of fuel into the chamber containing the spring 34, from the radial clearance defined between the outer peripheral surface of the outer bush and the bore in the tubular body member 23.

The force which is generated by the fuel under pressure acting upon the inner bush 31 is transmitted directly to the spring abutment and thereby assists the force generated by the fuel pressure acting on the valve member, to overcome the force exerted by the spring. Once the spring force has been overcome, the valve member lifts away from the seating to allow flow of fuel through the outlet orifice 14. The extent of movement of the inner bush is limited by its abutment with the plate 27 and once it engages the plate it can no longer assist the movement of the valve member. The valve member moves to its fully open position in which the spring abutment 32A engages the stop 36, when the fuel pressure at the inlet increases to a higher value. In the intermediate or first stage of opening of the valve member, fuel can flow through the outlet 14 at a restricted rate and the degree of restriction to the flow of fuel can be increased by progressive tightening of the tubular body member 23 onto the body 10 such tightening reducing the thickness of the washer 24. Adjustment of the clearance between the valve member and the seating would normally be carried out by supplying fuel to the inlet 20 with the spring 34 removed.

As an alternative to or in addition to, the use of the soft washer, elastic deformation of the collar 18A can be relied upon to provide the required range of adjustment.

The use of the internally tapered collar 18A and the tapered portion of the body 10, allows a fuel inlet to be attached to the body 10 without the need for brazing or welding and the application of an axial force ensures a fuel tight seal which is further facilitated by the fact that the tapered internal surface of the collar is relieved by the provision of the groove which is connected to the fuel inlet 20.

By the provision of the guide means 16 which is closer to the seating 13 than the bearing bush, it is easier to maintain the concentric relationship between the seating and the valve member which is of particular importance if the clearance between the valve member and the seating is used to provide restriction to the flow of fuel. Moreover, the problems which can arise when an elongated member is located at three axially spaced positions are overcome by the allowed radial movement of the guide bush 29.

I claim:

1. A fuel injector for supplying fuel to an internal combustion engine, comprising an elongated body in which is defined a bore, a seating forming at one end of the bore, an elongated valve member extending within the bore and forming a clearance therewith, the valve member being shaped at one end for co-operation with said seating to control flow of fuel through an outlet from a fuel inlet which communicates with said clearance, a guide bush carried by the body and located adjacent the other end of the valve member thus allowing said valve member to align with said seating, and allowing limited axial movement under the action of fuel pressure in said clearance, and, allowing the formation of a seal to prevent escape of fuel from said clearance, the valve member being guided for axial movement by the guide bush and resilient means acting on the valve member to urge the valve member into contact with the seating, the valve member defining a surface against which fuel under pressure in the clearance can act to lift the valve member from the seating said valve member and the wall of the bore being constructed to form a guide means for the valve member, the guide means being located intermediate the guide bush and the seating passage means being provided to allow flow of fuel past the guide means, and said guide bush being allowed limited radial movement within the body.

2. A fuel injector according to claim 1 in which said guide means comprises an enlargement on the valve member, said enlargement co-operating with a portion of the bore which is formed in an insert forming part of the body, the insert being formed from harder material than the remaining portion of the body and defining the seating and the outlet.

3. A fuel injector according to claim 2 in which that said passage means comprises flutes formed in the surface of the enlargement.

4. A fuel injector according to claim 1 in which said guide bush is located between a pair of spaced washers which are supported in the body, the fuel pressure in the clearance acting on the guide bush to drive it into seating engagement with one of the washers.

5. A fuel injector according to claim 4 in which said guide bush comprises inner and outer bushes, the inner bush having a smaller axial length than the outer bush and being axially slidable relative thereto by an amount as determined by said washers, the inner bush forming a bearing for the valve member, and a spring abutment engaged with the adjacent end of the valve member, the spring abutment overhanging the valve member so as to be engageable by the inner bush whereby the force developed by the fuel pressure acting on the inner bush will assist the movement of the valve member away from the seating until the movement of the inner bush is halted by said one washer.

6. A fuel injector according to claim 5 in which said guide bush and the washers are mounted on a part of the body which is adjustably mounted relative to the remaining portion of the body whereby the extent of movement of the valve member away from the seating whilst such movement is assisted by the force developed on the inner bush can be adjusted.

7. A fuel injector according to claim 6 in which said part comprises a tubular body member which is in screw thread engagement with the remaining portion of the body.

8. A fuel injector according to claim 7 including a collar mounted on said remaining portion of the body, a washer interposed between said collar and the tubular body member said washer forming a seal therebetween and being deformable to allow controlled tightening of the tubular body member and the remaining portion of the body.

9. An injector according to claim 8 in which said collar and said remaining portion of the body define complementary tapered surfaces, which are urged into firm engagement during tightening of the tubular body member, said collar defining a fuel inlet passage which communicates with said clearance.

10. An injector according to claim 9 in which said tubular body member carries a hollow cap, the cap serving to retain said one washer in engagement with the tubular body member and also accommodating a coiled compression spring one end of which is engaged with the spring abutment and the other end of which is in engagement with an adjustable abutment carried by the cap, said abutment carrying a stop engagable by the spring abutment to limit the extent of movement of the valve member away from the seating.

11. A fuel injector for supplying fuel to an internal combustion engine, comprising an elongated body in which is defined a bore, a seating forming at one end of the bore, an elongated valve member extending within the bore and forming a clearance therewith, the valve member being shaped at one end for co-operation with said seating to control flow of fuel through an outlet from a fuel inlet which communicates with said clearance, a guide bush carried by the body and located adjacent the other end of the valve member, the valve member being guided for axial movement by the guide bush and resilient means acting on the valve member to urge the valve member into contact with the seating, the valve member defining a surface against which fuel under pressure in the clearance can act to lift the valve member from the seating said valve member and the wall of the bore being constructed to form a guide means for the valve member, the guide means being located intermediate the guide bush and the seating passage means being provided to allow flow of fuel past the guide means, and said guide bush being allowed limited radial movement within the body, said guide bush being located between a pair of spaced washers which are supported in the body, the fuel pressure in the clearance acting on the guide bush to drive it into seating engagement with one of the washers.

12. A fuel injector according to claim 11, in which said guide means comprises an enlargement on the valve member, said enlargement co-operating with a portion of the bore which is formed in an insert forming part of the body, the insert being formed from harder material than the remaining portion of the body and defining the seating and the outlet.

13. A fuel injector according to claim 12, in which that said passage means comprises flutes formed in the surface of the enlargement.

14. A fuel injector according to claim 11, in which said guide bush comprises inner and outer bushes, the inner bush having a smaller axial length than the outer bush and being axially slidable relative thereto by an amount as determined by said washers, the inner bush forming a bearing for the valve member, and a spring abutment engaged with the adjacent end of the valve member, the spring abutment overhanging the valve member so as to be engageable by the inner bush whereby the force developed by the fuel pressure acting on the inner bush will assist the movement of the valve member away from the seating until the movement of the inner bush is halted by said one washer.

15. A fuel injector according to claim 14, in which said guide bush and the washers are mounted on a part of the body which is adjustably mounted relative to the remaining portion of the body whereby the extent of movement of the valve member away from the seating whilst such movement is assisted by the force developed on the inner bush can be adjusted.

16. A fuel injector according to claim 15, in which said part comprises a tubular body member which is in screw thread engagement with the remaining portion of the body.

17. A fuel injector according to claim 16, including a collar mounted on said remaining portion of the body, a washer interposed between said collar and the tubular body member said washer forming a seal therebetween and being deformable to allow controlled tightening of the tubular body and the remaining portion of the body.

18. An injector according to claim 17, which said collar and said remaining portion of the body define complementary tapered surfaces, which are urged into firm engagement during tightening of the tubular body member, said collar defining a fuel inlet passage which communicates with said clearance.

19. An injector according to claim 18, in which said tubular body member carries a hollow cap, the cap serving to retain said one washer in engagement with the tubular body member and also accommodating a coiled compression spring one end of which is engaged with the spring abutment and the other end of which is in engagement with an adjustable abutment carried by the cap, said abutment carrying a stop engageable the spring abutment to limit the extent of movement of the valve member away from the seating.

* * * * *